US005884458A

United States Patent [19]

Alvarez

[11] Patent Number: 5,884,458

[45] Date of Patent: Mar. 23, 1999

[54] PAPER WRAPPING MACHINE

[76] Inventor: Oscar Alvarez, 5700 Mariner South, Apt. 701, Tampa, Fla. 33609-3422

[21] Appl. No.: 908,757

[22] Filed: Aug. 8, 1997

[51] Int. Cl.[6] ..... B65B 09/02

[52] U.S. Cl. ..... 53/553; 53/555; 53/526; 53/528; 53/76

[58] Field of Search ..... 53/553, 554, 555, 53/528, 526, 76, 74

[56] References Cited

U.S. PATENT DOCUMENTS

| | | | |
|---|---|---|---|
| 2,586,580 | 2/1952 | Truscott | 53/553 |
| 2,828,590 | 4/1958 | Swartz | 53/553 |
| 3,014,233 | 12/1961 | Gibbons | 53/553 |
| 3,158,973 | 12/1964 | Monaghan | 53/553 |
| 3,355,857 | 12/1967 | Tobey | 53/553 |
| 3,633,333 | 1/1972 | Schlemmer | 53/553 |
| 3,735,551 | 5/1973 | Pratt | 53/553 |
| 3,792,561 | 2/1974 | Carnes | 53/553 |
| 3,824,908 | 7/1974 | Rowell | 53/553 |
| 3,837,138 | 9/1974 | Terry | 53/553 |
| 4,466,228 | 8/1984 | Gess | 53/553 |
| 4,858,416 | 8/1989 | Monaghan | 53/553 |
| 4,974,824 | 12/1990 | Kimbel | 270/58 |
| 5,357,731 | 10/1994 | Conway | 53/374.4 |
| 5,428,937 | 7/1995 | Misik | 53/74 |

*Primary Examiner*—Daniel B. Moon
*Assistant Examiner*—James P. Calve
*Attorney, Agent, or Firm*—A. W. Fisher, III

[57] ABSTRACT

A wrapping machine for wrapping articles such as newspapers in individual protective packets comprising a support assembly having a feed station for introducing unwrapped articles into the machine for wrapping and a pick-up station for retrieving wrapped articles from the wrapping machine mounted on opposite ends thereof, a transport/wrapping assembly for moving the articles from the feed station to the pick-up station and a film supply for enclosing the article between a first flexible protective film sheet and a second flexible protective film sheet, a film sealing assembly for sealing the opposite sides and the opposite ends of the first flexible protective film sheet and the second flexible protective film sheet together to form a protective packet enclosing the article therein, a film cutting assembly for separating adjacent protective packets and a control assembly including at least one sensor to detect articles moving through the wrapping machine and to selectively activate and deactivate the sealing assembly and cutting assembly.

13 Claims, 4 Drawing Sheets

PAPER WRAPPING MACHINE

BACKGROUND OF THE INVENTION

1. Field of the Invention

A wrapping machine for wrapping articles such as newspapers within individual protective packets to protect the articles.

2. Description of the Prior Art

Numerous efforts have been made to wrap various articles such as newspapers.

U.S. Pat. No. 5,428,937 describes a machine for packaging articles comprising a conveyor to transport a newspaper through an entrance into the machine. The newspaper imparts a tension on both a top sheet deployed from a first roll and a bottom sheet deployed from a second roll. A top and bottom dance bar communicates with a top and bottom sheet, respectively. In response to the tension, each dance bar simultaneously releases a brake and activates an electric motor causing the first and second rolls to rotate and feed out the top and bottom sheet, respectively. The top and bottom sheet is guided over the top and bottom surface of the newspaper by a pair of first and second edge guides, respectively, for preventing lateral movement of the top and bottom sheets. A cutting and sealing mechanism comprising a front sealing bar is placed into contact with the top and bottom sheets near the rear edge of the newspaper for simultaneously sealing together and cutting the top and bottom sheets. The front sealing bar comprises a heated metal body having a cutting blade protruding from a sealing edge.

U.S. Pat. No. 4,974,824 shows a method of distributing articles including collating newspaper inserts into separate stacks. The stacks of collated newspaper inserts are wrapped to provide separate wrapped packages. Newspaper news sections are collated into separate groups. The groups of collated newspaper news sections with the wrapped packages of collated newspaper inserts are distributed to customers. The wrapping of the stacks of inserts includes applying film sheeting about the stacks, sealing the sheeting applied to the stacks, and severing the sheeting to separate the stacks from one another to provide the separate wrapped packages. The wrapped packages of collated newspaper inserts are stacked together and stored until the time of distribution with the groups of articles news sections.

U.S. Pat. No. 4,683,708 relates to partially overlapping printed sheets which are transported from an inserting or other producing or processing machine delivered into a stacking unit which accumulates groups of overlapping sheets and dumps such groups into an intermittently operated wrapping unit wherein the groups are confined in film foils. The sheets which are intercepted during evacuation of a freshly formed group from the stacking unit are diverted into an accumulating unit which gathers the diverted sheets into piles and dumps the piles into a magazine for packing or for admission into one or more additional wrapping units.

U.S. Pat. No. 3,559,367 teaches a horizontal, continuously moving conveyor adapted to carry articles individually in a flat position to an enveloping station where the articles are packaged in a protective film. The enveloping station has a transport mechanism that is actuated responsive to a newspaper sensor located at the conveyor. Two rolls of protective film are supported above and below the plane of the conveyor to rotate about horizontal axes so as to feed film to the enveloping station. The ends of the two rolls of film are sealed together across the entrance to the enveloping station. As each newspaper approaches the enveloping station, the sensor actuates the transport mechanism of the enveloping station, thereby moving the newspaper through the enveloping station behind the sealed ends of the two rolls of film. Consequently, the film envelops the top and bottom surfaces of the newspaper. After the newspaper passes the sensor, the transport mechanism of the enveloping station stops and a film cutter and sealer is actuated. The film is thus cut and sealed transverse to its length near the entrance to the enveloping station and is sealed along its sides. One transverse seal is utilized for the rear edge of one packaged newspaper and the front edge of the next newspaper. The transport mechanism moves the newspaper through the enveloping station at a faster horizontal speed than the continuously moving conveyor.

U.S. Pat. No. 4,991,376 shows a method and an apparatus for wrapping a product, particularly a bundle of articles or magazines, especially an extra thick bundle or an extra thin bundle comprising a few or a single newspaper or magazine. The product is carried on a conveyor system to a curtain of film formed by an upper and a lower sheet of film. The curtain accompanies the product and is auto-sealed behind the product after which the sheets of film are separated in the middle of the sealing region. The curtain of film is re-established and the product is provided with a wrapper. The deflection roller or the like which defines the upper limit of the sheet of film is carried by drive device such as cylinders which are arranged to displace the deflection roller in such a way that its upper portion will be supplied quickly and substantially without tensile force at the start of a wrapping operation if the height of the product is slight, or at the end of the wrapping operation if the height of the product is particularly great.

SUMMARY OF THE INVENTION

The present invention relates to a wrapping machine for wrapping articles such as newspapers in individual protective packets comprising a support assembly having a feed station and a pick-up station disposed at opposite ends thereof, a transport/wrapping assembly means for moving the newspapers from the feed station to the pick-up station and enclosing the individual newspapers between an upper or first and a lower or second flexible protective film sheet, a film sealing assembly for sealing opposite sides and opposite ends of the upper or first and the lower or second flexible protective films sheets together such that the individual newspapers are enclosed therebetween to form the corresponding protective packet, a film cutting assembly for cutting the ends of the sealed upper or first and the lower or second flexible protective film sheets separating adjacent protective packets and a control means for detecting the individual newspapers moving through the wrapping machine and for generating control signals to selectively activate and deactivate the film sealing assembly and the film cutting assembly as more fully described herein.

The support assembly comprises a pair of side support frames held in fixed spaced relationship relative to each other by a plurality of substantially horizontal cross-members.

The feed station comprises a substantially horizontal article support feed platform operatively mounted to the support assembly by a substantially horizontal feed platform support member adjacent the feed station; while, the pick-up station comprises a substantially horizontal article support pick-up platform operatively mounted to the support assembly by a substantially vertical pick-up platform support member adjacent the pick-up station.

The transport/wrapping assembly comprises a film supply means including a first or upper film supply section and a second or lower film supply section to supply the first or upper flexible protective film sheet and the second or lower flexible protective film sheet respectively to the transport/wrapping assembly and an article transport means including a first article transport section and a second article transport section operatively coupled to a transport drive means as described more fully hereinafter to receive and engage the first or upper flexible protective film sheet and the second or lower flexible protective film sheet to move or draw the upper of first flexible protective film sheet and the lower or second flexible protective film sheet with newspapers or articles disposed therebetween through the transport/wrapping assembly from the feed station to the pick-up station.

The first transport section comprises a first upper and a first lower film transport means; while, the second transport section comprises a second upper and a second lower film transport means to cooperatively form an article wrapping zone therebetween.

The film sealing assembly comprises a first film sealing section disposed within the article wrapping zone to seal opposite sides of the upper or first flexible protective film sheet and the lower or second flexible protective film sheet together and a second file sealing section disposed between the article wrapping zone and the pick-up station to seal opposite ends of the upper or first flexible protective film sheet and the lower or second flexible protective film sheet as described more fully hereinafter.

The film cutting assembly is disposed adjacent the pick-up station to cut the ends of the upper or first flexible protective film sheet and the lower or second flexible protective film sheet as the articles pass therethrough to form the individual protective packets.

The control means includes a sensor means such as an electric eye coupled to the control means to detect the position of an article relative to the film cutting assembly and the second film sealing station and logic means to generate a control signal to energize or activate the transport assembly drive motor of the transport drive means, the first and second film sealing sections Of the film sealing assembly and the film cutting assembly.

To set up the operation of the wrapping machine, the upper or first protective film sheet and the lower or second protective film sheet are fed or threaded between the second upper film transport means and the second or lower film transport means to engage the film engaging protrusions of the upper drive member or chain and the lower drive member or chain respectively.

Newspapers are introduced or fed into the wrapping machine through the feed station and placed between the upper or first flexible protective film sheet and the lower or second flexible protective film sheet. Initially, with power on, the control means energizes the transport assembly drive motor which drives the first and second transport sections rotating the pair of first upper disks and the pair of first lower disks, and the pair of second upper disks and the pair of second lower disks such that the film engaging protrusions of the upper drive member or chain and the lower drive member or chain draw or pull the upper or first flexible protective film sheet and the lower or second flexible protective film sheet together with the article or newspaper therebetween through the article wrapping zone.

As the newspaper moves through the second transport station to the first transport station, the first heating element and the first and second roller members of the first film sealing section seal the sides of the upper or first flexible protective film sheet and the lower or second flexible protective film sheet. As the newspaper passes between the upper or first sensing element and the lower or second sensing element, the control means stops or deenergizes the transport assembly drive motor and sends a signal to the second film sealing section and the film cutting assembly energizing the positioning means moving the second heating element and the cutting edge from the first to the second position to simultaneously seal and cut the ends of the upper or first flexible protective film sheet and the lower or second flexible protective film sheet from the immediately preceding protective packet. After a predetermined period of time the positioning means is retracted to the first position and the transport/wrapping assembly is reenergized to continue the cycle of wrapping the individual articles in individual protective packets.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
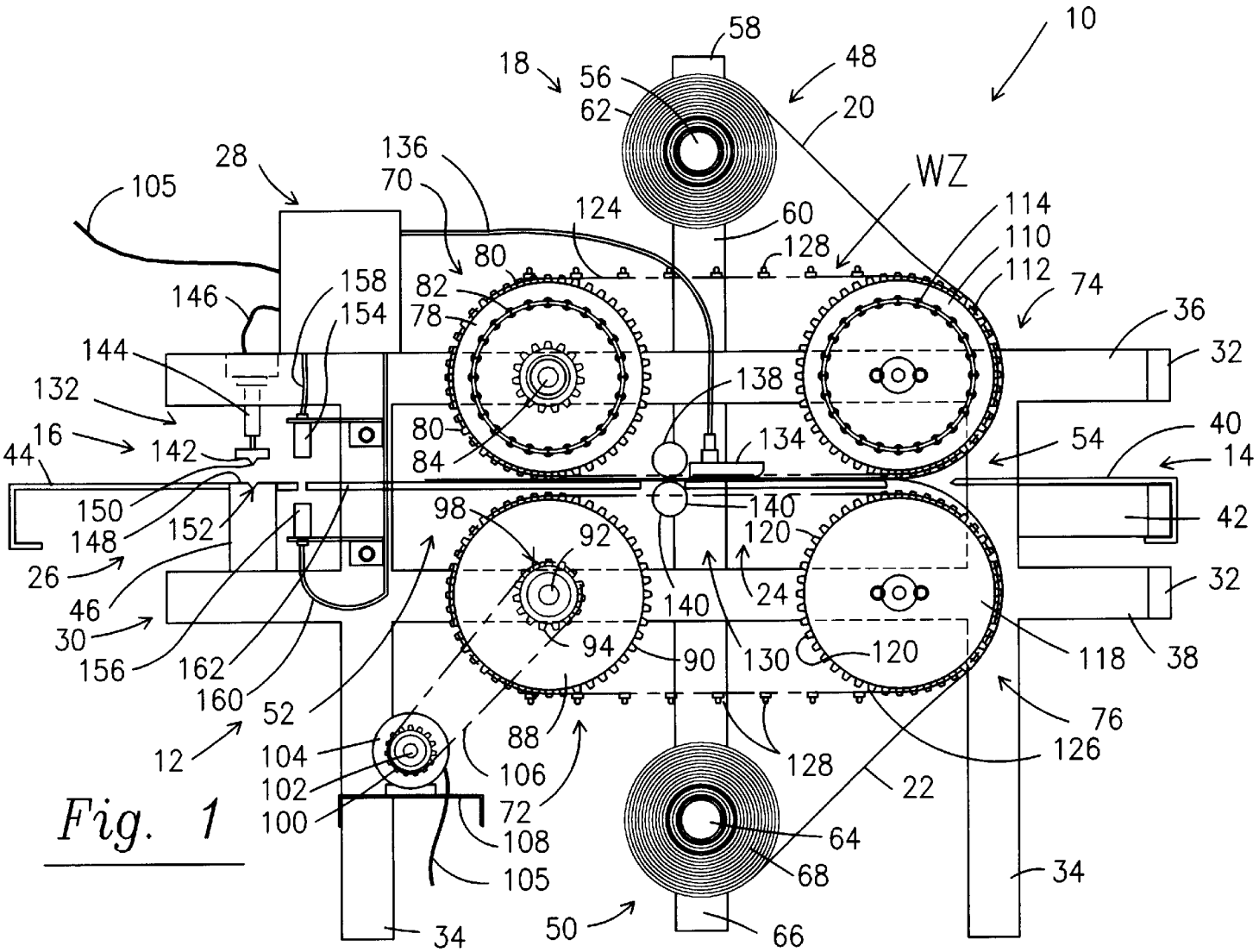
FIG. 1 is a side view of one side of the wrapping machine of the present invention.

As shown in FIGS. 1 through 4, the present invention relates to a wrapping machine generally indicated as 10 for wrapping articles such as newspapers N in individual protective packets PP comprising a support assembly generally indicated as 12 having a feed station generally indicated as 14 for introducing unwrapped newspapers N into the wrapping machine 10 and a pick-up station generally indicated as 16 for retrieving the wrapped newspapers N from the wrapping machine 10 disposed at opposite ends thereof, a transport/wrapping assembly means generally indicated as 18 for moving the newspapers N from the feed station 14 to the pick-up station 16 and enclosing the individual newspapers between an upper or first and a lower or second flexible protective film sheet indicated as 20 and 22 respectively, a film sealing assembly generally indicated as 24 for sealing opposite sides and opposite ends of the upper or first and the lower or second flexible protective film sheets 20 and 22 together such that the individual newspapers N are enclosed therebetween to form the corresponding protective packet PP, a film cutting assembly generally indicated as 26 for cutting the ends of the sealed upper or first and the lower or second flexible protective film sheets 20 and 22 for separating adjacent protective packets PP and a control means 28 for detecting the individual newspapers N moving through the wrapping machine 10 and for generating control signals to selectively activate and deactivate the film sealing assembly 24 and the film cutting assembly 26 as more fully described herein.

As shown in FIGS. 1 through 4, the support assembly 12 comprises a pair of side support frames each generally indicated as 30 held in fixed spaced relationship relative to each other by a plurality of substantially horizontal cross-members each indicated as 32. Each side support frame 30 comprises a pair of substantially vertical side frame members each indicated as 34 held in substantially parallel relationship relative to each other by an upper and a lower substantially horizontal interconnecting side frame member indicated as 36 and 38 respectively.

As shown in FIGS. 1 through 4, the feed station 14 comprises a substantially horizontal article support feed platform 40 operatively mounted to the support assembly 12 by a substantially horizontal feed platform support member 42 extending outwardly from each of the substantially vertical side frame members 34 adjacent the feed station 14; while, the pick-up station 16 comprises a substantially horizontal article support pick-up platform 44 operatively mounted to the support assembly 12 by a substantially vertical pick-up platform support member 46 extending upwardly from each of the lower substantially horizontal interconnecting side frame members 38 adjacent the pick-up station 16.

Figure 2:
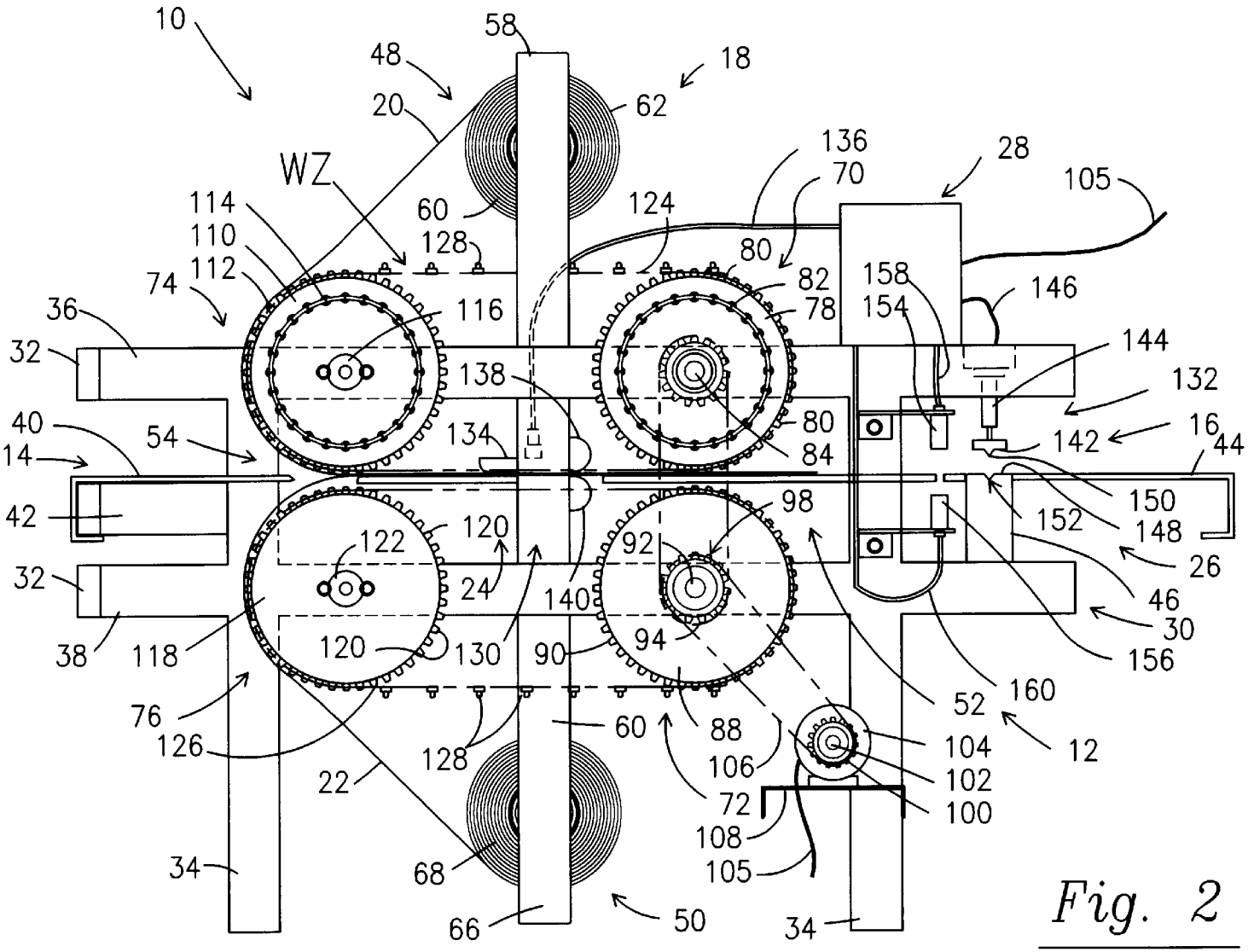
FIG. 2 is a side view of the opposite side of the wrapping machine of the present invention.
Figure 3:
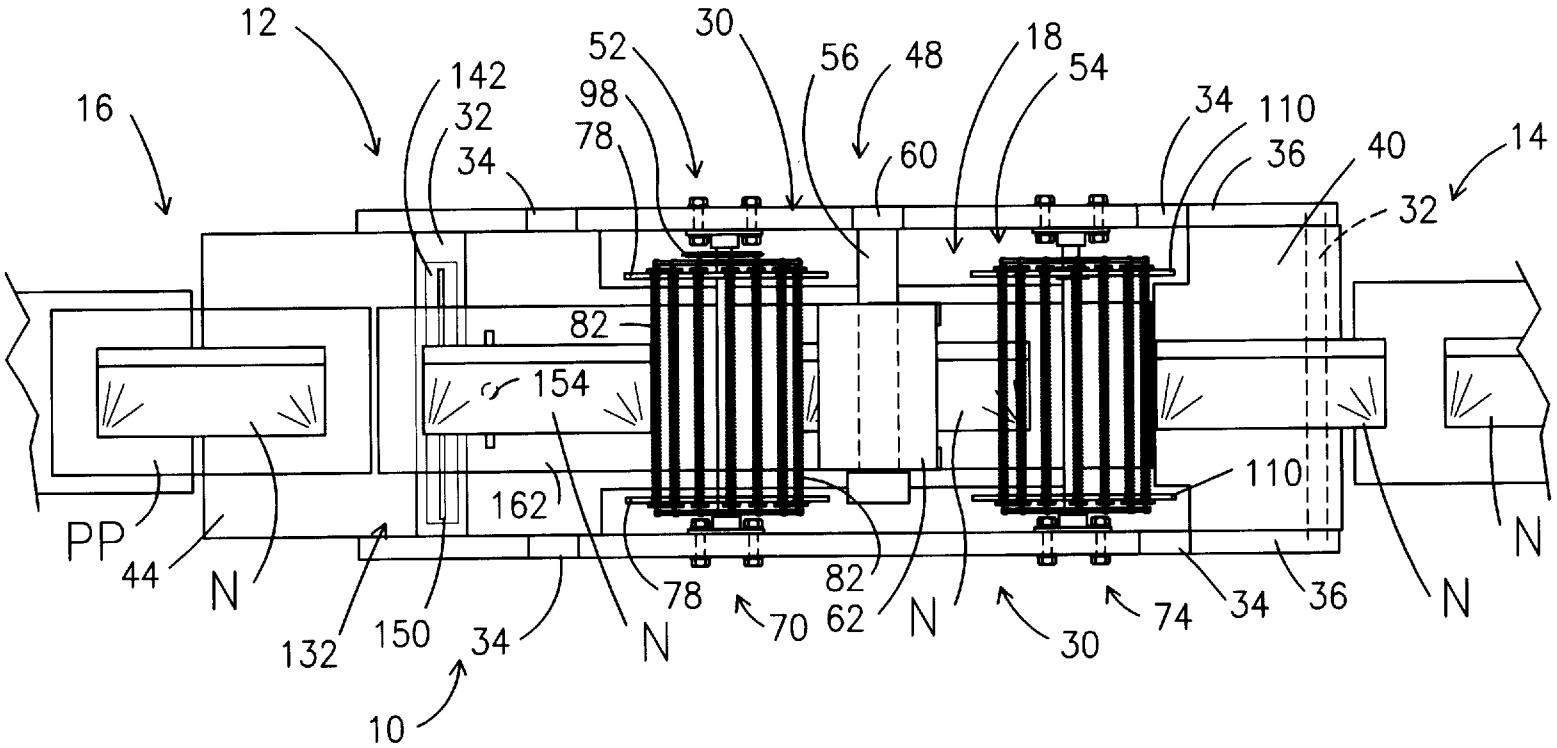
FIG. 3 is a top view of the wrapping machine of the present invention.

As shown in FIGS. 1 through 3, the transport/wrapping assembly 18 comprises a film supply means including a first or upper film supply section and a second or lower film supply section generally indicated as 48 and 50 to supply the first or upper flexible protective film sheet 20 and the second or lower flexible protective film sheet 22 respectively to the transport/wrapping assembly 18 and an article transport means including a first article transport section and a second article transport section generally indicated as 52 and 54 respectively operatively coupled to a transport drive means as described more fully hereinafter to receive and engage the first or upper flexible protective film sheet 20 and the second or lower flexible protective film sheet 22 to move or draw the upper or first flexible protective film sheet 20 and the lower or second flexible protective film sheet 22 with newspapers or articles N disposed therebetween through the transport/wrapping assembly 18 from the feed station 14 to the pick-up station 16 attached to the proximal and distal end of the support assembly 12 respectively.

As shown in FIGS. 1 and 2, the first or upper film supply section 48 comprises a first or upper substantially horizontal film support member 56 extending inwardly toward the transport/wrapping assembly 18 from the upper portion 58 of a substantially vertical film supply support member 60 affixed to one side support frame 30 to rotatable support a roll or spool of flexible protective film 62 to supply the upper or first flexible protective film sheet 20 to the transport/wrapping assembly 18 and the second or lower film supply section 50 comprises a second or lower substantially horizontal film support member 64 extending inwardly toward the transport/wrapping assembly 18 from the lower portion 66 of the substantially vertical film supply support member 60 to rotatably support a roll or spool of flexible protective film 68 to supply the lower or second flexible protective film sheet 22 to the transport/wrapping assembly 18.

As shown in FIGS. 1 through 3, the first transport section 52 comprises a first upper and a first lower film transport means generally indicated as 70 and 72 respectively; while, the second transport section 54 comprises a second upper and a second lower film transport means generally indicated as 74 and 76 respectively to cooperatively form an article wrapping zone WZ therebetween. The first upper film transport means 70 comprises a pair of first upper disks each indicated as 78 including a plurality of teeth each indicated as 80 extending outwardly from the periphery thereof and having a plurality of resilient spring film engaging elements each indicated as 82 extending therebetween rotatable coupled between the upper substantially horizontal interconnecting side frame members 36 by a first upper shaft 84 having an upper drive gear 86 affixed to one end portion thereof. The first lower film transport means 72 comprises a pair of first lower disks each indicated as 88 including a plurality of teeth each indicated as 90 extending outwardly from the periphery thereof rotatable coupled between the lower substantially horizontal interconnecting side frame members 38 by a first lower shaft 92 having lower drive gear 94 affixed to one end portion thereof and operatively coupled to the upper drive gear 86 by a flexible interconnecting drive member or chain 96. In addition, a transport assembly drive gear 98 affixed to an end portion of the first lower shaft 92 is operatively coupled to an output gear 100 affixed to an output shaft 102 of a transport assembly drive motor 104 by a flexible transport assembly drive member or chain 106. The transport assembly drive motor 104 is coupled to the control means 28 by a control cable or conductor 105 attached to one of the substantially vertical side frame member 34 by a mounting bracket 108. The second upper film transport means 74 comprises a pair of second upper disks each indicated as 110 including a plurality of teeth each indicated as 112 extending outwardly from the periphery thereof and having a plurality of resilient spring film engaging elements each indicated as 114 rotatably coupled between the upper substantially horizontal interconnecting side frame members 36 by a second upper shaft 116. The second lower film transport means 76 comprises a pair of second lower disks each indicated as 118 including a plurality of teeth each indicated as 120 extending outwardly from the periphery thereof rotatably coupled between the lower substantially horizontal interconnecting side frame members 38 by a second lower shaft 122.

The first upper disks 78 and the corresponding second upper disks 110, and the first lower disks 88 and the corresponding second lower disks 118 on each side of the support assembly 12 are operatively coupled by a corresponding upper drive member or chain 124 and a corresponding lower drive member or chain 126 respectively. Each upper drive member or chain 124 and each lower drive member or chain 126 includes a plurality of film engaging protrusions each indicated as 128 to engage the upper or first flexible protective film sheet and the lower or second flexible protective film sheet respectively as described more fully hereinafter.

As shown in FIGS. 1 through 3, the transport drive means comprises the upper drive gear 86, the lower drive gear 94, the flexible interconnecting drive member or chain 96, the transport assembly drive gear 98, the output gear 100, the output shaft 102, the transport assembly drive motor 104, the flexible transport assembly drive member or chain 106, the mounting bracket 108, the upper drive member or chain 124 and the lower drive member or chain 126.

Figure 4:
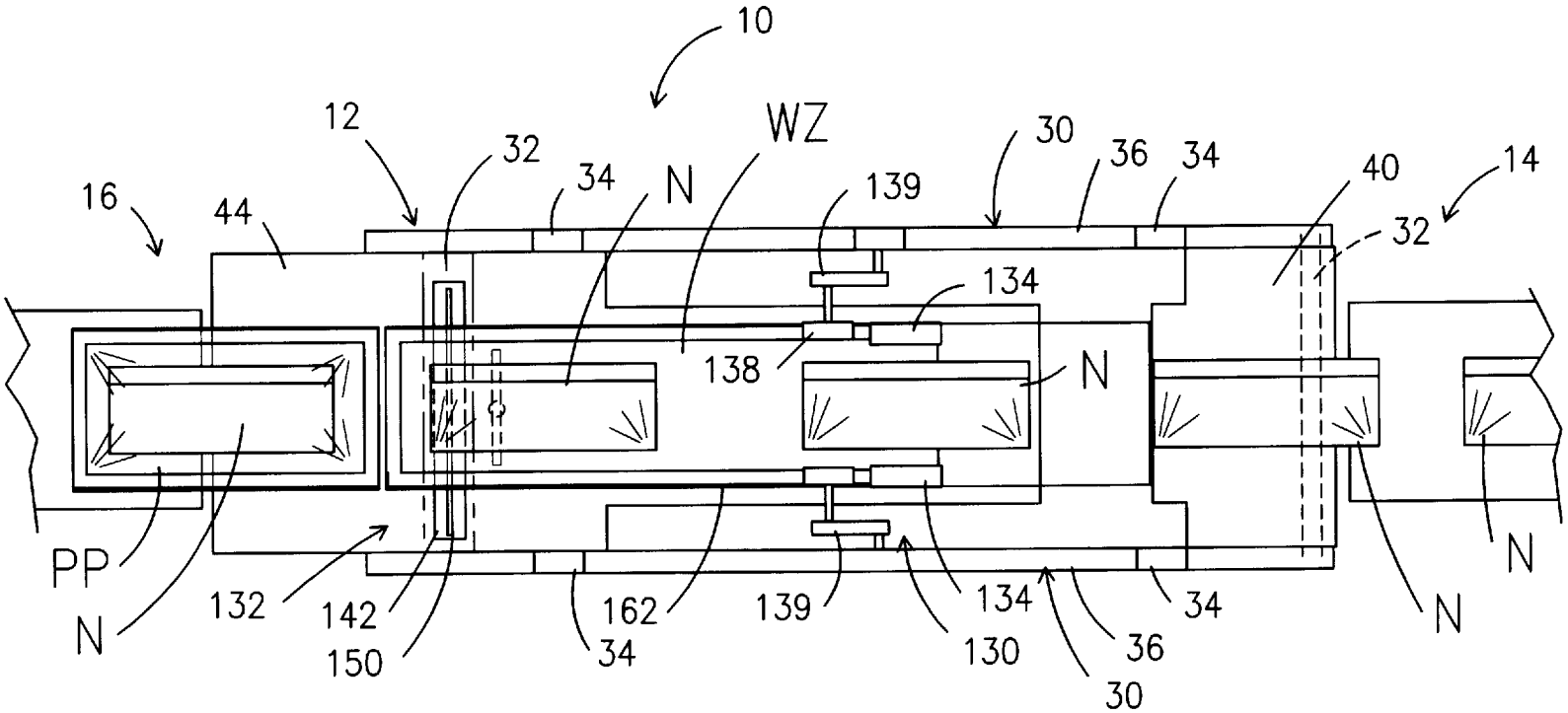
FIG. 4 is a top view of the wrapping machine of the present invention without a portion of the transport/wrapping assembly.

As shown in FIGS. 1, 2 and 4, the film sealing assembly comprises a first film sealing section generally indicated as 130 disposed within the article wrapping zone WZ to seal opposite sides of the upper or first flexible protective film sheet 20 and the lower or second flexible protective film sheet 22 together and a second film sealing section generally indicated as 132 disposed between the article wrapping zone WZ and the pick-up station 16 to seal opposite ends of the upper or first flexible protective film sheet 20 and the lower or second flexible protective film sheet 22 as described more fully hereinafter. The first film sealing section 130 comprises a first heating element 134 disposed on each side of the article wrapping zone WZ to engage and heat opposite sides of the of the upper or first flexible protective film sheet 20 when the first heating element 134 is energized by the control means 28 through a control cable or conductor 136 and a sealing mechanism including a first and second roller member indicated as 138 and 140 respectively disposed on opposite sides of the article wrapping zone WZ adjacent the corresponding first heating element 134 to receive the heated upper or first flexible protective film sheet 20 and the lower or second flexible protective film sheet 22 therethrough and to press opposite sides of the upper or first flexible protective film sheet 20 and the lower or second flexible protective film sheet 22 together to bond or seal the sides thereof. Each first roller member 138 may be spring biased by spring 139. Of course, an ultra sound or other suitable bonding device can be used in place of the first heating elements 134 to seal opposite sides of the upper or first flexible protective film sheet 20 and the lower or second flexible protective film sheet 22. The second film sealing section 132 comprises a second heating element 142 mounted between the upper substantially horizontal interconnecting side frame members 36 of the support assembly 12 by a piston or positioning means 144 coupled to the control means 28 by a control cable or conductor 146 to selectively move the second heating element 142 between a first or upper position and a second or lower position to engage and heat the upper or first flexible protective film sheet 20 when the second heating element 142 is moved from the first or upper position to the second or lower position by the positioning means 144 to press the ends of the upper or first flexible protective film sheet 20 and the lower or second flexible protective film sheet 22 together between the second heating element 142 and an anvil 148 to bond or seal the ends thereof. Of course, an ultra sound or other suitable bonding device can be used to seal opposite ends of the upper or first flexible protective film sheet 20 and the lower or second flexible protective film sheet 22.

As shown in FIGS. 1 through 4, the film cutting assembly 26 is disposed adjacent the pick-up station 16 to cut the ends of the upper or first flexible protective film sheet 20 and the lower or second flexible protective film sheet 22 as the articles N pass therethrough to form the individual protective packets PP. As shown, the film cutting assembly 26 may comprise a sharp cutting edge 150 formed on the second heating element 142 and a corresponding cutting groove 152 formed in the anvil 148 to receive the sharp cutting edge 150 when the second heating element 142 is in the second or lower position to cut the ends of the upper or first flexible protective film sheet 20 and the lower or second flexible protective film sheet 22.

As shown in FIGS. 1 and 2, the control means 28 includes a sensor means such as an electric eye comprising a first or upper sensing element 154 and a second or lower sensing element 156 coupled to the control means 28 by control cables or conductors 158 and 160 respectively to detect the position of an article N relative to the film cutting assembly 26 and the second film sealing station 102 and logic means to generate a control signal to energize or activate the transport assembly drive motor 104 of the transport drive means, the first and second film sealing sections 130 and 132 of the film sealing assembly and the sharp cutting edge 150 of the film cutting assembly 26.

To set up the operation of the wrapping machine 10, the upper or first protective film sheet 20 and the lower or second protective film sheet 22 are fed or threaded between the second upper film transport means 74 and the second or lower film transport means 76 to engage the film engaging protrusions 128 of the upper drive member or chain 124 and the film engaging protrusions 128 of the lower drive member or chain 126 respectively.

As shown in FIGS. 3 and 4, newspapers N are introduced or fed into the wrapping machine 10 through the feed station 14 and placed between the upper or first flexible protective film sheet 20 and the lower or second flexible protective film sheet 22. Initially, with power on, the control means 28 energizes the transport assembly drive motor 104 which drives the first and second transport sections 52 and 54 rotating the pair of first upper disks 78 and the pair of first lower disks 88, and the pair of second upper disks 110 and the pair of second lower disks 118 such that the film engaging protrusions 128 of the upper drive member or chain 124 and the lower drive member or chain 126 draw or pull the upper or first flexible protective film sheet 20 and the lower or second flexible protective film sheet 22 together with the article or newspaper N therebetween through the article wrapping zone WZ along a substantially horizontal support platform 162 attached between the side support frames 30 in substantially coplanar relationship relative to the substantially horizontal article support feed platform 40 of the feed station 14 and the substantially horizontal article support pick-up platform 44 of the pick-up station 16. The resilient spring film engaging elements 82 and 114 of the first and second transport sections 52 and 54 engage the upper surface of the upper or first flexible protective file sheet 20 to press the upper or first flexible protective film sheet 20 newspaper N against and the lower or second flexible protective film sheet 22 and the substantially horizontal support platform 162.

As the newspaper N moves through the second transport station 54 to the first transport station 52, the first heating element 134 and the first and second roller members 138 and 140 of the first film sealing section 130 seal the sides of the upper or first flexible protective film sheet 20 and the lower or second flexible protective film sheet 22. As the newspaper N passes between the upper or first sensing element 154 and the lower or second sensing element 156, the control means 28 stops or deenergizes the transport assembly drive motor 104 and sends a signal to the second film sealing section 132 and the film cutting assembly 26 energizing the positioning means 144 moving the secondary heating element 142 and the cutting edge 150 from the first to the second protection to simultaneously seal and cut the ends of the upper or first flexible protective film sheet 20 and the lower or second flexible protective film sheet 22 from the immediately preceding protective packet PP. After a predetermined period of time the positioning means 144 is retracted to the first position and the positioning means 144 is reenergized to continue the cycle of wrapping the individual articles N in protective packets PP.

What is claimed is:

1. A wrapping machine for wrapping newspaper articles in individual protective packets comprising a support assembly including a pair of side support frames having a feed station for introducing unwrapped articles into the machine for wrapping and a pick-up station for retrieving wrapped articles from the wrapping machine mounted on opposite ends thereof, a transport/wrapping assembly for moving the articles from said feed station to said pick-up station and a film supply for enclosing the article between a first flexible protective film sheet and a second flexible protective film sheet, a film sealing assembly for sealing the opposite sides and the opposite ends of said first flexible protective film sheet and said second flexible protective film sheet together to form a protective packet enclosing the article therein, a film cutting assembly for separating adjacent protective packets and a control assembly including at least one sensor to detect articles moving through said wrapping machine and to selectively activate and deactivate said transport/wrapping assembly, said sealing assembly and cutting assembly, said transport/wrapping assembly comprises a film supply means including a first film supply section and a second film supply section to supply the first flexible protective film sheet and the second flexible protective film sheet respectively to said transport/wrapping assembly and an article transport means including a first article transport section and a second article transport section respectively operatively coupled to a transport drive means to receive and engage the first flexible protective file sheet and the second flexible protective film sheet to move the first flexible protective film sheet and the second flexible protective film sheet with newspapers or articles disposed therebetween through said transport/wrapping assembly from said feed station to said pick-up station attached to the proximal and distal end of said support assembly respectively, said first article transport section comprises a first upper film transport means and a first lower film transport means and said second article transport section comprises a second upper film transport means and a second lower film transport means to cooperatively form an article wrapping zone therebetween, said a first upper film transport means comprises a pair of first upper disks having a plurality of resilient spring film engaging elements extending therebetween rotatably coupled between said support frames by a first upper shaft having an upper drive gear affixed to one end portion thereof, said first lower film transport means comprises a pair of first lower disks rotatably coupled between said side support frame by a first lower shaft having a lower drive gear affixed to one end portion thereof and operatively coupled to said upper drive gear by a flexible interconnecting drive member, said second upper film transport means comprises a pair of second upper disks having a plurality of resilient spring film engaging elements rotatably coupled between said side support frames by a second upper shaft and said second lower film transport means comprises a pair of second lower disks rotatably coupled between said side support frames by a second lower shaft and said wrapping machine further includes a transport assembly drive gear affixed to an end portion of said first lower shaft operatively coupled to an output gear affixed to an output shaft of a transport assembly drive motor by a flexible transport assembly drive member wherein said transport assembly drive motor is coupled to said control means by a control cable, said first upper disks and said corresponding second upper disks and said first lower disks and said corresponding second lower disks on each side of said support assembly are operatively coupled by a corresponding upper drive member and a corresponding lower drive member respectively and each said upper drive member and each said lower drive member includes a plurality of film engaging protrusions extending outwardly therefrom to engage the first flexible protective film sheet and the second flexible protective film sheet respectively.

2. The wrapping machine of claim 1 wherein each side support frame comprises a pair of substantially vertical side frame members held in substantially parallel relationship relative to each other by an upper and a lower substantially horizontal interconnecting side frame member.

3. The wrapping machine of claim 2 wherein said feed station comprises a substantially horizontal article support feed platform operatively mounted to said support assembly by a feed platform support member extending outwardly from each of said substantially vertical side frame members adjacent said feed station and said pick-up station operatively mounted to the support assembly by a pick-up platform support member extending upwardly from each of said lower substantially horizontal interconnecting side frame members adjacent said pick-up station.

4. The wrapping machine of claim 1 wherein said first film supply section comprises a first film support member extending inwardly toward said transport/wrapping assembly from the upper portion of a film supply support member affixed to one said side support frame to rotatably support a roll or spool of flexible protective film to supply the first flexible protective film sheet to said transport/wrapping assembly and said second film supply section comprises a second film support member extending inwardly toward said transport/wrapping assembly from the lower portion of said film supply support member to rotatably support a roll or spool of flexible protective film to supply the second flexible protective film sheet to said transport/wrapping assembly.

5. The wrapping machine of claim 1 wherein the film sealing assembly comprises a first film sealing section to seal opposite sides of the first flexible protective film sheet and the second flexible protective film sheet together and a second film sealing section disposed adjacent said pick-up station to seal opposite ends of the first flexible protective film sheet and the second flexible protective film sheet.

6. The wrapping machine of claim 5 wherein said first film sealing section comprises a first heating element disposed on each side of said wrapping machine to engage and heat opposite sides of the first flexible protective film sheet when said first heating element is energized by said control means.

7. The wrapping machine of claim 6 wherein said first film sealing section further includes a sealing mechanism including a first and second roller member disposed on each side of said wrapping machine adjacent said corresponding first heating element to receive the heated first flexible protective film sheet and the second flexible protective film sheet therethrough and to press opposite sides of the first flexible protective film sheet and the second flexible protective film sheet together to bond or seal the sides thereof.

8. The wrapping machine of claim 7 wherein each said first roller member is spring biased.

9. The wrapping machine of claim 5 wherein said second film sealing section comprises a second heating element mounted between said side support frame by a positioning means coupled to said control means to selectively move said second heating element between a first position and a second position to engage and heat the first flexible protective film sheet when said second heating element is moved from said first position to said second position by said positioning means to press the ends of the first flexible protective film sheet and the second flexible protective film sheet to bond or seal the ends thereof.

10. The wrapping machine of claim 9 wherein said film cutting assembly comprises a cutting edge formed on said second heating element and a corresponding cutting groove formed in an anvil to receive said cutting edge when said second heating element is in said second position to cut the ends of the first flexible protective film sheet and the second flexible protective film sheet.

11. The wrapping machine of claim 10 wherein said control means further includes a sensor means to detect the position of an article relative to said film cutting assembly and said second film sealing station and logic means to generate a control signal to energize said assembly drive motor of the transport drive means, said first and second film sealing sections of said film sealing assembly and said positioning means.

12. The wrapping machine of claim 1 wherein said film cutting assembly is disposed adjacent said pick-up station to cut the ends of the first flexible protective film sheet and the second flexible protective film sheet as the articles pass therethrough to form the individual protective packets.

13. The wrapping machine of claim 12 wherein said control means further includes a sensor means to detect the position of an article relative to said film cutting assembly and said second film sealing station and logic means to generate a control signal to energize said assembly drive motor of the transport drive means, said first and second film sealing sections of said film sealing assembly and said positioning means.

* * * * *